United States Patent [19]

Lafitte, Jr.

[11] 4,201,024

[45] May 6, 1980

[54] PLASTIC/COMPOSITE STRUCTURAL PANEL

[75] Inventor: George A. Lafitte, Jr., Atlanta, Ga.

[73] Assignee: Lockheed Corporation, Burbank, Calif.

[21] Appl. No.: 759,884

[22] Filed: Jan. 17, 1977

[51] Int. Cl.[2] ..... E04B 1/62; E04C 2/38

[52] U.S. Cl. ..... 52/394; 52/536; 52/539

[58] Field of Search ..... 52/394, 393, 309.1, 52/536, 542, 86, 497, 495, 478, 90, 539

[56] References Cited

U.S. PATENT DOCUMENTS

| | | | |
|---|---|---|---|
| 719,396 | 1/1903 | Watson | 52/496 |
| 3,156,210 | 11/1964 | Lyon | 52/394 |
| 3,434,260 | 3/1969 | Carter | 52/542 |
| 3,968,604 | 7/1976 | Hills | 52/86 |

*Primary Examiner*—John E. Murtagh
*Attorney, Agent, or Firm*—A. L. Carter

[57] ABSTRACT

A panel of molded plastic or cured composite materials configured to span the space between a pair of beam or support members by a slideable engagement between each of the opposite ends of the panel and its adjacent beam or support member, and the panel sealingly and lockingly engageable along each of its opposite edges to another panel adjacent each edge of the first panel. The panels are fabricated whereby the panel end engagement means with the beam or support members define a predetermined path which in turn is variable as the panels can be arcuately flexed widthwise upon installation engagement with the beam or support members while at the same time minimizing load deflection of the panels lengthwise when installed.

7 Claims, 10 Drawing Figures

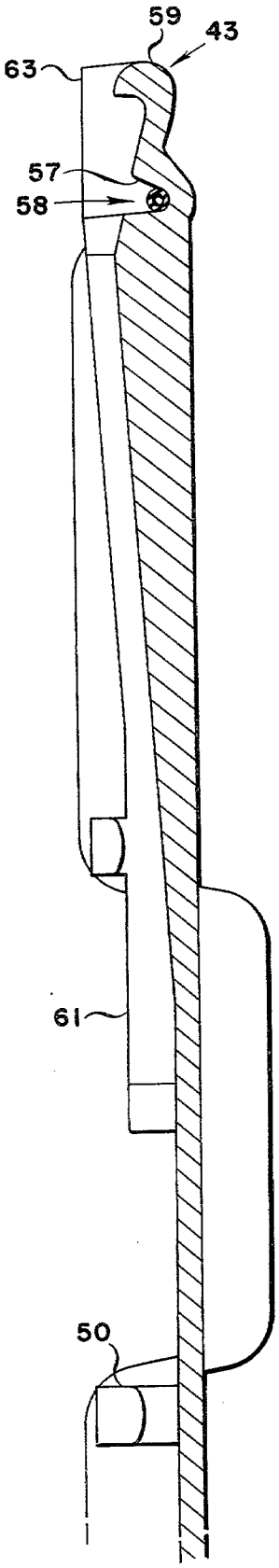
FIG. 6
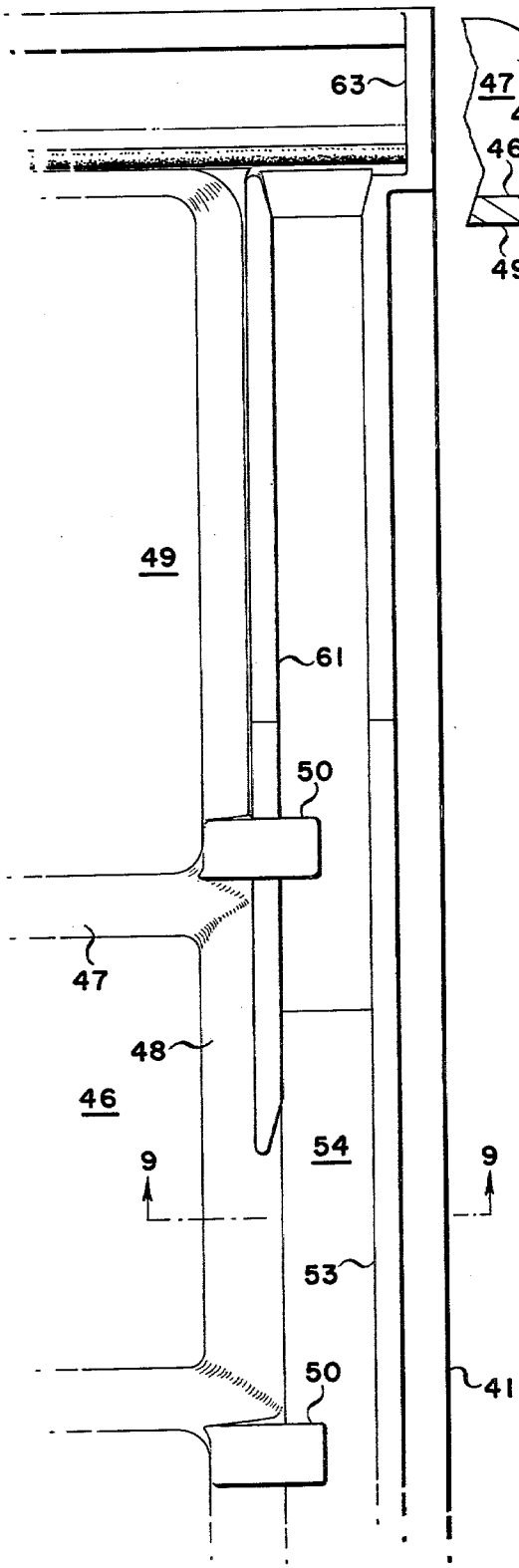
FIG. 8
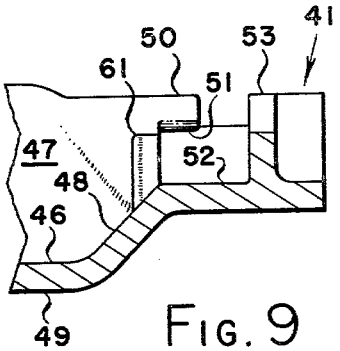
FIG. 9
FIG. 7
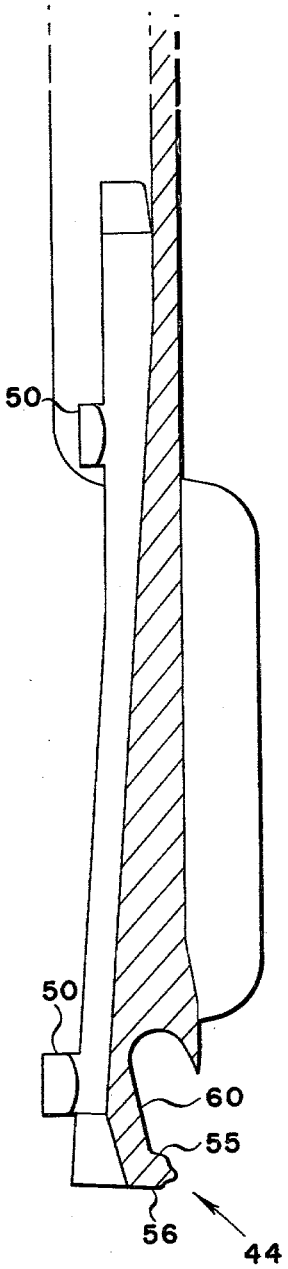

PLASTIC/COMPOSITE STRUCTURAL PANEL

This invention relates to a combined structural and cover panel for a shelter or building, and more particularly a panel member formed by injection molded plastic (or assemblies thereof) or cured composite materials with the panel configured to permit an installation sliding engagement between a pair of spaced rail members along two opposite edges of the panel and permit weather sealed interconnection between adjacent panel members on the other two sides of each panel: such panel configuration in turn permitting arcuate or radial deformation of the panel in one direction while minimizing deflection of the panel by loads in the direction normal to the first direction.

One use of the panel of this invention is with the erectable shelter as shown and described in U.S. Pat. No. 3,968,604, dated July 13, 1976, wherein a series of panel members are slideably engaged with an adjacent pair of arch assemblies that are pivotally connected in a spaced relationship to ground connections; the panel members slideably engaging each of the arch members and serving to retain said arch member in an upright assembled position while at the same time providing weather cover between the arch members. In this prior art U.S. Pat. No. 3,968,604, the edgewise grooves in the panels would permit slideable engagement with rail devices on the arch members which is of a substantially constant radii with the panels in turn having substantially little, if any, arcuate deflection about the edge engageable with the arch members upon installation. It has been found that with different size shelters or buildings as covered by the above identified prior art patent, i.e., shelters having different size radii for the arch members, that a different sized or configured panel had to be manufactured for substantially each different arch member radii, as well as the prior panel configuration would not permit installation upon arch members of varying radii throughout their arcuate length.

Accordingly, it is an object of this invention to provide a panel member that adapts to varying contours in one direction while retaining structural strengths to minimize deflections in another direction.

Another object of this invention is to provide a panel that interlocks with adjacent panels with a snug, structural joint, as well as one whereby a weather seal, if incorporated, engages when panels are interlocked, without the tensioning of panels to engage both the locking means and the weather seal.

Yet another object of this invention is to provide a panel that both functions as a part of the primary structure as well as serves as a cover or enclosure member.

A further object of this invention is to provide a panel member that will permit of rapid assembly or disassembly with both an adjacent panel member and the support or structure members being spanned.

It is still a further object of this invention to provide a panel with rigidity in one direction and flexibility in a perpendicular direction for variable contours.

And still a further object of this invention is provide a universal common panel that can be used on dissimilar or variable contours that is of lighter weight, and that is of greater ease in manufacturing in that one size and one configuration panel can be utilized over a great range of building sizes and contour variations ranging from a substantially flat or straight installation to an arcuate installation with as little as approximately a six foot radii.

Other objects and advantages will become apparent from the following description taken in connection with the accompanying drawings in which:

FIG. 1 is a perspective view of one embodiment of this invention;

FIGS. 2 and 3 are views taken along lines 2—2 and 3—3 respectively of FIG. 1;

Figure 5:
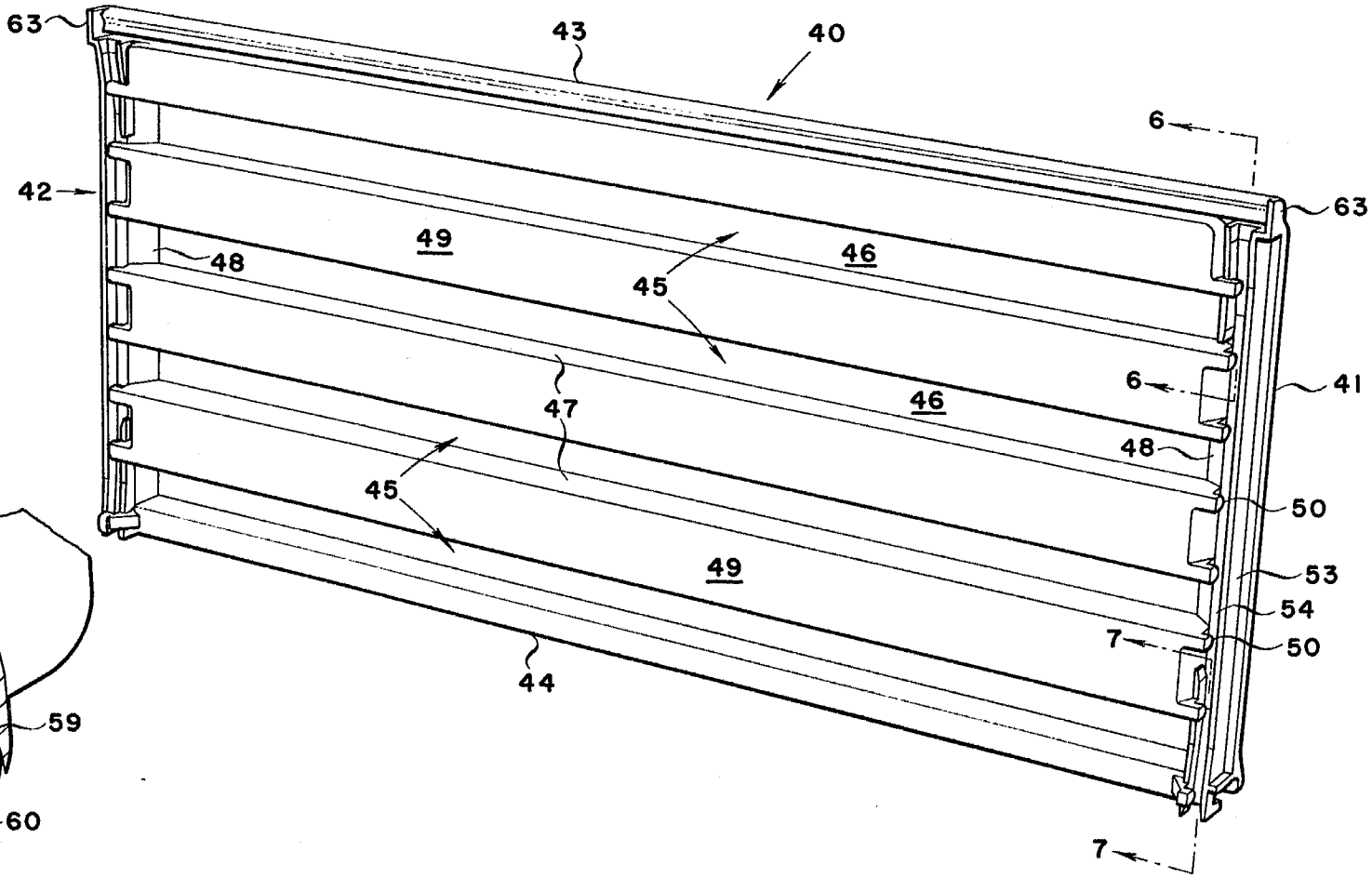
FIG. 5 is a perspective view of a second embodiment of this invention.
Figure 10:
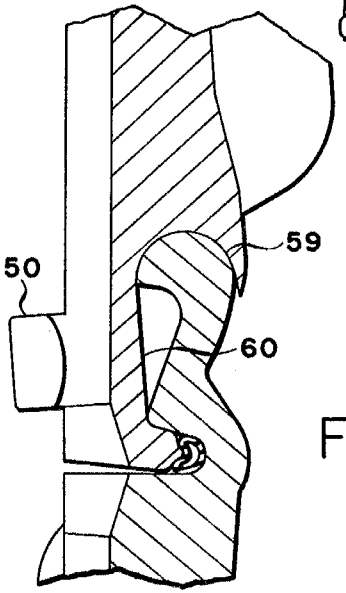

FIGS. 6 and 7 are views taken along lines 6—6 and 7—7 of FIG. 5;

FIG. 8 is a partial view of one corner of the invention embodiment of FIG. 5;

FIG. 9 is a view taken along lines 9—9 of FIG. 8; and,

FIG. 10 is a partial cross-sectional view of a pair of interconnected panels of the invention embodiment of FIG. 5.

Generally stated, this invention comprises a panel member of injection molded plastic or cured composite materials capable of carrying loads in one direction while at the same time capable of arcuate flexure or bending in a direction opposite to the load carrying direction, with the panels in turn capable of an interlocking connection with additional panel members along opposite, parallel sides.

More specifically, and with reference to FIGS. 1 through 4, one embodiment of this invention consists of a panel member 10 of a substantially rectangular overall plan shape with one side having a substantially flat surface 11 bounded by edges 12, 13, 14 and 15. The side of panel 10 opposite the flat surface 11 has a plurality of rib members 16 extending longitudinally between edges 12 and 13, substantially parallel to edges 14 and 15, and substantially perpendicular to flat surface 11. The maximum length of ribs 16 is such that their opposite ends are near or proximate the edges 12 and 13 with each end of rib 16 having a cut out or undercut 17 to form a lip or overhang portion 18 with an undersurface 19 spaced from and in confrontation with the main body surface of panel 10; the purpose of this arrangement being explained in more detail hereinafter.

Figure 1:
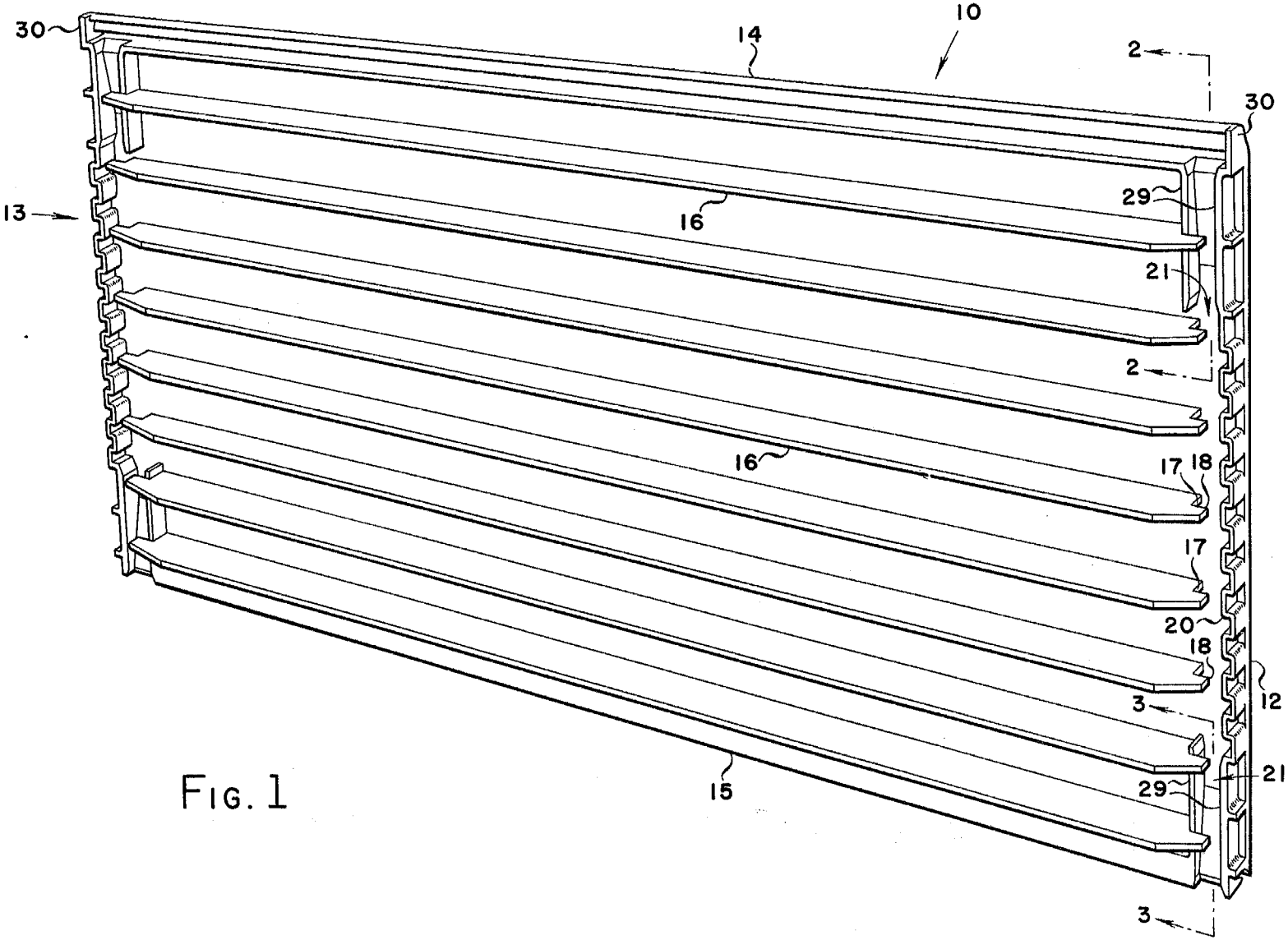

Along edges 12 and 13 there is an optional edge skirt 20 extending from the main sheet or plate portion of panel 10 on the same side thereof that ribs 16 project from: the exact longitudinal configuration of edge skirt 20 not being critical since it may be of a corrugated nature shown in FIG. 1 or of merely a straight web or thin wall configuration so long as it is thin enough to permit some flexibility to permit panel deflection as explained below.

It is preferred that should an edge skirt 20 be incorporated that it extends from the surface of panel number 10 approximately the distance between the confronting surfaces of the main body of panel 10 and undersurface 19 of ribs 16 discussed above, whereby a passage or channel 21 is provided longitudinally between edges 14 and 15 along each edge 12 and 13 which will receive an appropriate configured rail or guide device for a sliding engagement of the panels relative thereto. While a specific cross-sectional configuration of passage 21 is not critical, it is to be understood that its shape should have some conformity to the cross-sectional shape of the structural support or rail means the panel is connected to and most preferably oversized so as to permit an easily slideable engagement with the structural support member the panel is mounted on or engaged with.

Figure 2:
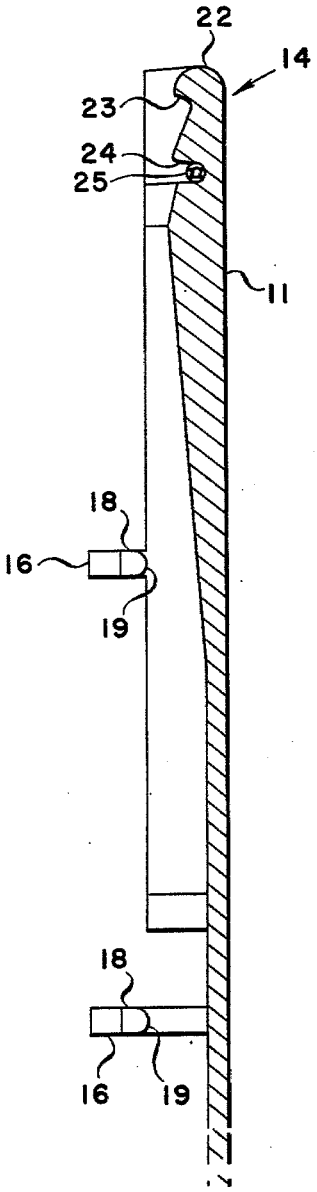
Figure 3:
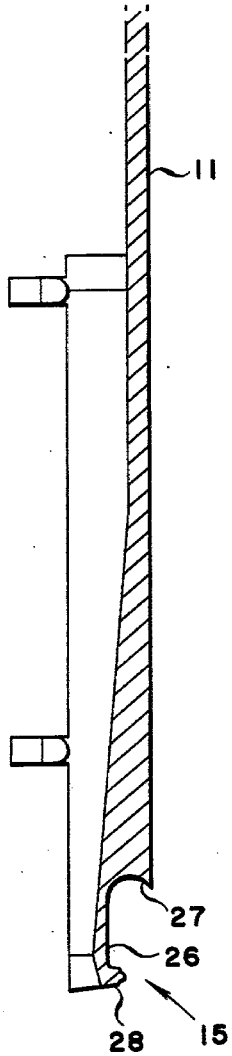
Figure 4:
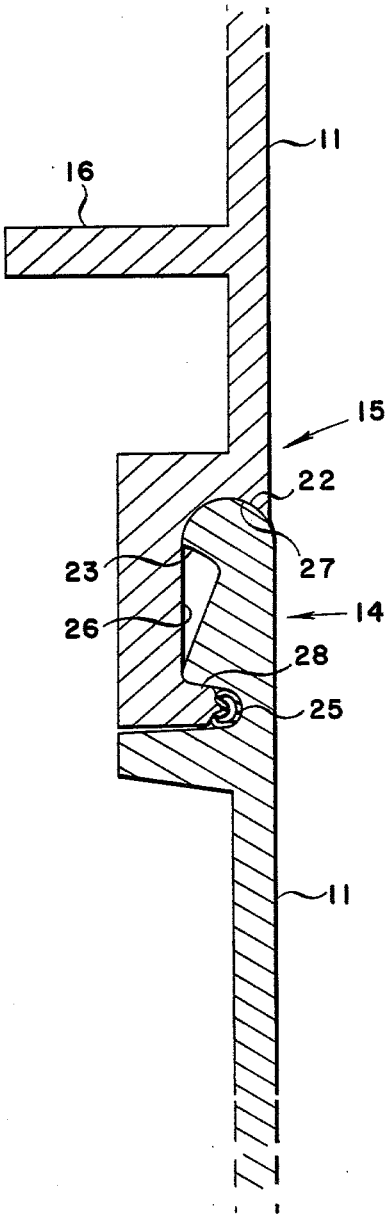
FIG. 4 is a partial cross-sectional view of a pair of interconnected panels of the invention embodiment of FIG. 1.

The edges 14 and 15 of each panel 10 are longitudinally shaped as shown in FIGS. 2 and 3 so as to permit a locking engagement with an adjacent panel as shown in FIG. 4. The outermost longitudinal surface 22 of edge 14 is rounded or arcuately shaped, followed on the inner side by an undercut 23 extending to a channel 24 containing a pliable or deformable seal member 25.

The edge 15 of each panel 10 as shown in FIG. 3 comprises a longitudinally extending channel 26 having a rounded or arcuate undercut surface 27; the radial or arcuate configuration of undercut surface 27 corresponding to that of surface 22 of edge 14. A flange 28 forms the wall of channel 26 in confrontation to the surface 27, the flange 28 being sized to permit passage into channel 24 of edge 14 as seen in FIG. 4.

Installation of panels 10 is accomplished by the placement of a panel number across the gap or spacing between a parallel pair of rail members so that edges 12 and 13 of panel 10 may be placed in contact therewith: the station location for placement of panel 10 for connection with the rail members being at a position where the rails have appropriate cutouts to permit the lips 18 of ribs 16 to go under the rail surface as the panel 10 is either pulled or pushed beyond the cutout location in the same manner as shown and described in U.S. Pat. No. 3,968,604 identified above. The installation of a panel 10 is such that once the panel is moved into connecting engagement with the rail or guide members the edge 15 of the installed panel 10 is adjacent the rail cutout location in preparation for the next panel installation. The next panel 10 is then physically angulated relative to the installed panel and the surface 22 of edge 14 of the next panel being installed is placed into channel 26 of edge 15 of the installed panel and moved into contact with surface 27 of the installed panel. The panel being installed is then pivotally swung about its edge 14 with surfaces 22 and 27 in physical contact such that flange 28 is inserted into channel 24 and contacts or deforms seal 25 (if the seal 25 is utilized), whereupon the two adjacent panels become interlocked or engaged whereby the pair of panels may be slidingly pushed or pulled relative to the guide rails or support structure they are mounted on.

Because of the ribs 16 extending between edges 12 and 13 and parallel to edges 14 and 15, the flat surface 11 of each panel 10 is capable of assuming a substantial range of arcuate shapes about an axis parallel to ribs 16 upon installation of the panels on the guide rails or support members as well as retaining a substantially flat configuration from the presence of flat surface 11 without any deflection of the panel 10 when installed; the installed configuration of the panels being defined or controlled by the geometric path of the guide rails or support structure. Because of the slideable arrangement of the installed panels with the support or guide rail members, movement forces of the panels are transmitted from one panel to another through compression or tension depending upon whether the motion is pushing or pulling and thusly, depending upon the loads involved and the strength of the materials of panel 10, strengthening webs or members 29 may be incorporated in the corners of the panels 10 as appropriate or desired without serious detraction or degradation of the flexibility properties and capabilities of the panels. Likewise, it is to be understood that the purpose of edge skirts 20 on panels 10 is only necessary if the panels are utilized in a cover or weather protection environment bridging a pair of support members in a manner typified by U.S. Pat. No. 3,968,604. Also, while not critical in all installations, but serving to maintain adjacent panels in relative longitudinal or lateral alignment, as well as preclude water from inclement weather getting into the edge to edge connection of adjacent panels, an end wall 30 can be incorporated at the outer extremities of either edge 14 or 15 of the panels as seen in FIG. 1 where end walls 30 are incorporated with edge 14.

Referring now to FIGS. 5 through 10, there is shown a second embodiment of this invention wherein a panel 40, having edges 41, 42, 43 and 44 has the major portion of the intermediate area bounded by the edges formed or cured in a corrugated shape with the channels 45 of the corrugated structure extending intermediate edges 41 and 42 and parallel to edges 43 and 44. Each channel 45 is formed and bounded by a bottom surface 46, a pair of side surfaces 47 and a pair of end surfaces 48. This description of corrugation channels as seen in FIG. 5 applies also to the edge bounded surface of panel 40 on the opposite or unseen side; it being understood that surfaces 49 as seen in FIG. 5 represent the surface of the panel material opposite the bottom surfaces 46 of the channels formed on the opposite side of the panel 40 as seen in FIG. 5.

The side wall surfaces 47 of each channel relative to the bottom surface 46 may be at right angles or in an angular diverging relationship thereto, depending upon the strength and load resisting properties desired in the panel; it being preferable that some relative angularity take place other than right angles in view of the greater the draft angle in molding or curing tooling, the easier the manufacture of the panels. The overall height of the end surfaces 48 is less than the overall height of side surfaces 47 inasmuch as each end surface 48 extends to an appropriate surface of its respective edge 41 and 42 in the manner seen in FIG. 9.

A plurality of lugs or ears 50 project from various corrugation channels on one side of the panel in a outward direction toward edges 41 and 42. The lower surfaces 51 of the lug or ear 50 is vertically spaced from surface 52 which is the horizontal surface of edge 41 that the channel end wall 48 joins as seen in FIG. 9. If desired and appropriate, for the same purpose of edge skirt 20 discussed above, an edge skirt 53 can be included parallel with edge 41 to form a channel or passage 54 for the same purpose and function as discussed above relative to passage or channel 21 in the first described embodiment of this invention.

The edges 43 and 44 panels are very similar to the edges 14 and 15 of panel 10 discussed above. A potential exception to the similarity is in those instances where the adjacent panels 40, when interlocked or connected along edges 43 and 44, are pulled over the panel mounting rails or support structures. Because of such pulling movement, tension forces are created in the panels and in view of the overall corrugation configurations, edges 43 and 44 of the individual panel may have a tendency to separate or pull apart due to the tension or pulling forces reacting on the intermediate corrugated portions of the panel deflecting into a flatter sheet or shallower corrugated member. This tension force deflection does not occur along edges 41 and 42 due to their longitudinal flatness as compared to the cross sectional corrugation at an intermediate plane through panel 40 between the edges 41 and 42 and parallel thereto. To compensate for this membrane stretching effect, an undercut may be made on surface 55 of flange 56 along edge 44 for a portion of edge 44 extending between the two channels or passages 54 along edges 41 and 42. Alternatively, should such interpanel tensioning forces wish to be concentrated at the corner portions, this undercut may be made on the surface 57 or channel 58 in edge 43 which surface 57 is in confrontation with surface 55 of flange 56 when a pair of adjacent panels are interconnected and installed.

The interlocking assembly of adjacent panels 40 is accomplished in the same manner as discussed above in the first embodiment of this invention in that the rounded outermost surface of 59 of edge 43 is placed angularly into channel 60 on edge 44 of the adjacent and already installed panel 40, followed by the panel being installed then being swung down into position for flange 56 to become located in channel 58 and the lugs or ears 50 to go under the structures support or retaining rails upon sliding movement of the pair of interlocked panels.

The panels 40 may also include end walls 63 at the extreme ends of edge 43 for lateral alignment control and water sealing purposes if desired in the same manner as with the panels of the first embodiment discussed and described above. Likewise, strengthening ribs or members 61 may be incorporated proximate the corners of panel 43 for strengthening and load carrying and transmitting purposes if desired, as well as the edge skirts 53 may be dispensed with if the panels 43 are used in an installation without regard to water or weather closure.

Thusly, it can be seen that panels 43 can be a common panel used in a plurality of installed configurations in the same manner as panel 10 discussed above and that both panels 10 and 43 can be inserted for slideable engagement with guide rail or support structure arrangements ranging from flat to an arcuate configuration of as little as a few feet radius in the guide rail or support structure. Because of the ribs 16 on panels 10 and corrugation side walls 47 on panels 40, load deflection between the respective edges 12–13 and 41–42 are minimized while substantial arcuate deflection properties between respective edges 14–15 and 43–44 are retained. Also, it is believed readily apparent that these properties are retained in the panels 10 and 40 notwithstanding the elimination of the respective edge skirts 20 and 53 so long as the guide rails or support structure (not shown) are configured so that they have confronting flanges which will ride respectively between the undersurface 19 and the confronting surface in the case of panel 10 and between the lower surface 51 of lugs 50 and surface 52 in the case of panels 40.

While particular embodiments of the invention have been illustrated and described, it will be obvious to those skilled in the art that various changes and modifications may be made without departing from the invention and it is intended to cover in the appended claims all such changes and modifications that come within the true spirit and scope of the invention.

What is claimed is:

1. A two-sided, non-metallic structural panel of a rectangular shape with a first and second pair of opposite panel edges comprising;

first means incorporated along each of said first pair of opposite panel edges and on the same side of the panel to provide a pathway extending substantially the entire longitudinal length of the panel edges for a support flange to slideably pass therethrough when the panel is mounted on a pair of spaced support flanges;

second means incorporated along each of said second pair of opposite panel edges of mutually opposing configuration that are interlockingly engageable so that adjacent panels can be interconnected and when so connected can be both pulled and pushed relative to the support flanges when mounted thereon, said second means along one panel edge comprises a channel extending substantially the longitudinal length of the edge and having a first channel wall distal to the outermost limit of the edge and a second channel wall spaced from and confronting said first channel wall and proximal to the outermost limit of the edge, said first channel wall formed as a concave arcuate undercut and said second channel wall formed by an upstanding flange, said second means along the other panel edge comprises an edge outermost limit surface of a convex arcuate shape compatible with the concave arcuate undercut forming the first channel wall in the first panel edge and extending substantially the longitudinal length of the edge, and a longitudinally extending channel along said other panel edge and spaced from the convex arcuate shaped surface so as to receive the upstanding flange on the first panel edge of an adjacent panel when two panels are interconnected and the concave and convex arcuate surfaces are in contact with each other;

and third means extending between said first pair of opposite panel edges for resisting deflections between the first pair of opposite panel edges while minimizing resistance to arcuate deflections of the panel between the second pair of opposite panel edges.

2. A structural panel as defined in claim 1 including a pliable and deflectable seal means located in the lowermost portion of the longitudinally extending channel in said other panel edge for sealing engagement with said upstanding flange on the first edge of the adjacent panel when two panels are so interconnected.

3. A structural panel as defined in claim 1 including an end wall means on the extremities of one panel edge whereby interconnecting engagement between two adjacent panels can only be accomplished when the confronting edges of the two panels are in lateral alignment.

4. A structural panel as defined in claim 1 wherein said third means comprises a plurality of rib members extending from one side of the panel and parallel to the second pair of opposite panel edges.

5. A structural panel as defined in claim 4 including a pliable and deflectable seal means located in the lowermost portion of the longitudinally extending channel in said other panel edge for sealing engagement with said upstanding flange on the first edge of the adjacent panel when two panels are so interconnected.

6. A structural panel as defined in claim 1 wherein said third means comprises a corrugated configuration portion intermediate both said first and second pairs of opposite panel edges with the corrugation furrows and ridges extending parallel to the second pair of opposite panel edges.

7. A structural panel as defined in claim 6 including a pliable and deflectable seal means located in the lowermost portion of the longitudinally extending channel in said other panel edge for sealing engagement with said upstanding flange on the first edge of the adjacent panel when two panels are so interconnected.

* * * * *